United States Patent [19]

Park et al.

[11] Patent Number: 4,502,553

[45] Date of Patent: Mar. 5, 1985

[54] SPONGE CORING APPARATUS WITH REINFORCED SPONGE

[75] Inventors: Arthur Park, Odessa; Bob T. Wilson, Midland, both of Tex.

[73] Assignee: Diamond Oil Well Drilling, Midland, Tex.

[21] Appl. No.: 513,376

[22] Filed: Jul. 13, 1983

[51] Int. Cl.[3] ..... E21B 25/06

[52] U.S. Cl. ..... 175/59; 175/236; 166/228

[58] Field of Search ..... 175/59, 58, 232, 233, 175/236, 239; 166/264, 228, 233; 73/151

[56] References Cited

U.S. PATENT DOCUMENTS 2,257,344 9/1941 Maloney ..... 166/228

4,312,414 1/1982 Park ..... 175/59

*Primary Examiner*—James A. Leppink

*Assistant Examiner*—Thuy M. Bui

*Attorney, Agent, or Firm*—Jerry W. Mills; Gregory M. Howison; Nina L. Medlock

[57] ABSTRACT

A well coring apparatus (10) includes an outer barrel (12) and an inner barrel (18). A hollow sponge (50) is disposed along a liner (52) for insertion into the inner barrel (18). The sponge (50) is operable to absorb subterranean fluid from a well core (54). A plurality of reinforcing members (56) are disposed on the inner surface of the liner (52) to prevent movement of the sponge (50) with respect thereto. A plurality of orifices (58) are disposed in the surface of the liner (52) to allow gas and/or fluid to escape from the interior thereof when the subterranean fluid contained within the core (54) bleeds into the sponge (50).

15 Claims, 3 Drawing Figures

SPONGE CORING APPARATUS WITH REINFORCED SPONGE

TECHNICAL FIELD

This invention pertains in general to a well coring apparatus and, more particularly, to an apparatus for sponge coring in a subterranean well.

BACKGROUND OF THE INVENTION

In obtaining oil from areas where tertiary recovery is necessary, one of the primary requirements is to obtain accurate oil saturation data. Although other methods are utilized, coring is one of the primary methods for determining oil saturation data. In obtaining this data, it is important that it be as accurate as possible since very small inaccuracies can be the difference between profit and a loss in subsequent drilling operations. One reason for the inaccuracies incurred in coring is the result of washing of the cores by drilling mud filtrate which can remove a large fraction of the mobile oil that is present in the cores. This mobile oil is the oil that passes through the core and that provides one indication of future productivity of the well.

To analyze the amount of oil that is contained in a particular soil at a particular depth in the proximity of a subterranean well requires extraction of a sample of the well material. Analysis of this material yields the percent of fluid and/or gas contained therein which is utilized to determine the type of fluid, such as oil, contained therein and the pressure thereof. However, it is important in order to obtain an accurate analysis to extract the core in as intact a condition as possible. Since the fluid and gas are contained in the core material at a pressure dependent upon the depth of the well, extraction of this core to an environment with a lower pressure results in the fluid expanding somewhat and the gas coming out of solution. In addition, the mobile oil contained in the core may also drain or "bleed" out of the core and be lost.

One method for retaining mobile oil is sponge coring which is disclosed in U.S. Pat. No. 4,312,414, issued to the present Applicant. Sponge coring comprises disposing a high porosity sponge on the interior surface of the inner barrel of the well coring apparatus. The core is then forced into the inner barrel with the sponge disposed about the sides thereof. The oil and/or gas contained in the core then "bleeds" into the sponge thereby retaining an accurate profile of the oil along the longitudinal axis of the core.

To obtain proper absorption of the oil that bleeds from the core, it is necessary to have the core disposed adjacent the surface of the sponge in relatively close proximity. To do this, the inner diameter of the sponge coring member is dimensioned to be slightly less than the diameter of the core itself. This allows for a very tight fit therebetween. However, this presents problems such as breakage of the sponge and/or the core. If the sponge breaks, this can result in jamming, that is, the sponge preceding the core up through the inner barrel.

Normally, the sponge is an open celled material that has dead air space which receives the fluid from the core. This presents a problem in that the air volume in the sponge must have a place to escape in order to relieve back pressure that may build up and provide room for the oil. If this pressure remains within the sponge itself, the accuracy of the saturation data can be somewhat inhibited.

In view of the above disadvantages, there exists a need for a sponge coring apparatus that relieves pressure within the sponge during the coring process and minimizes breakage of the sponge as the core proceeds into the inner barrel.

SUMMARY OF THE INVENTION

The present invention disclosed and claimed herein comprises a sponge core for insertion into the inner barrel of the well coring apparatus. The sponge core includes a support member for disposal within the inner barrel adjacent the sides thereof and having a bore defined therethrough along the longitudinal axis of the well coring apparatus. An absorbent member is disposed in the support member and attached to the sides thereof for receiving a well core and absorbing the subterranean fluid that bleeds therefrom. A reinforcing member is disposed on the portion of the support member to which the absorbent member is attached. The reinforcing member inhibits movement of the absorbent member during formation of the core.

In another embodiment of the present invention, relief is provided for pressure that builds up within the absorbent member during formation of the core and bleeding of fluids therefrom. This relief is provided in the form of a plurality of orifices disposed on the support means communicating between the sponge and the exterior of the support member. This allows for gas and/or fluid to exhaust therefrom.

In yet another embodiment of the present invention, the reinforcing member includes a plurality of longitudinal tracks or ridges that are attached to the support member and aligned along the longitudinal axis of the coring apparatus. The absorbent member in the form of a polyurethane foam sponge is formed over the tracks and adhered thereto. This adherence to the tracks provides an increased amount of retention therefor which minimizes movement of the sponge with respect to the support member.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
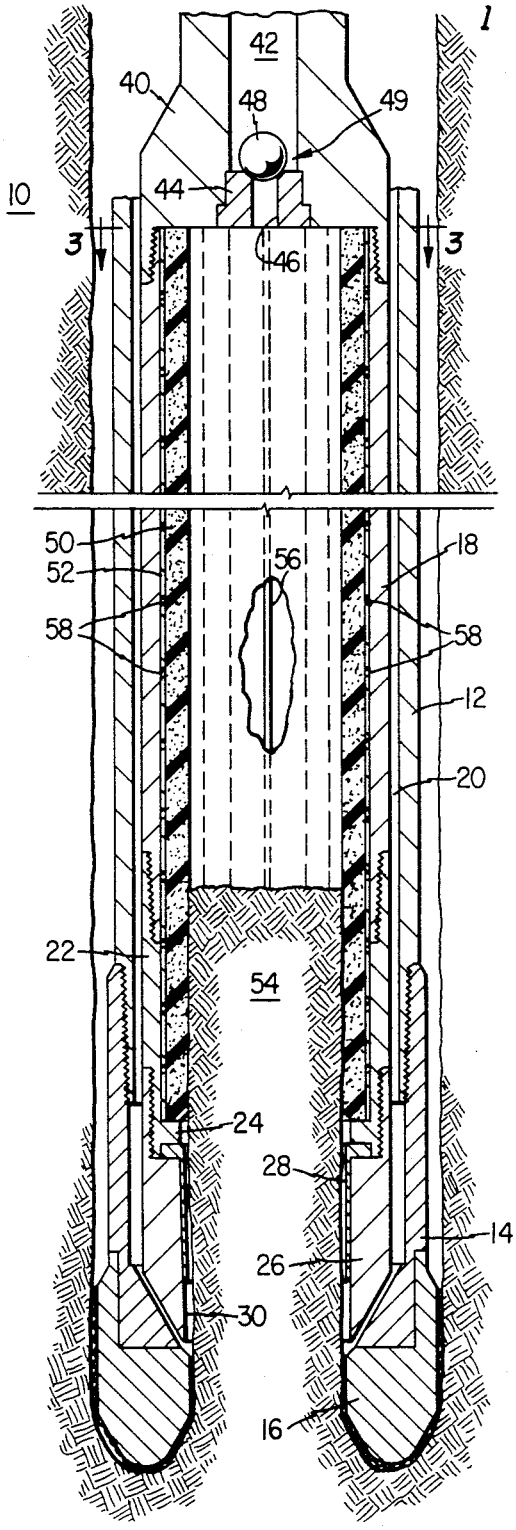
FIG. 1 illustrates a cross-sectional view of a well coring apparatus utilizing the present invention.

Referring now to FIG. 1, there is illustrated a cross-sectional view of a well coring apparatus 10. The well coring apparatus 10 includes an outer barrel 12 that has a bit sub 14 disposed on the end thereof. The bit sub 14 is utilized to couple a coring bit 16 to the outer barrel 12. The coring bit 16, the bit sub 14 and the outer barrel 12 are co-rotatable by an external drilling apparatus (not shown) for drilling a core. The description of the coring procedure is described in U.S. Pat. No. 4,312,414, issued to the present Applicant, the body of which is incorporated herein by reference.

An inner barrel 18 is disposed within the outer barrel 12 such that an annular channel 20 is formed therebetween. This annular channel 20 allows drilling fluids to pass therethrough to the coring bit 16. The inner barrel 18 is stationary with respect to rotation of the outer barrel 12 and is designed for receiving the core that is formed during the coring process. The inner barrel 18 has a receiving end for receiving the well core and an exhaust end for exhausting material contained within the inner barrel 18 as the core progresses upward therethrough. An inner barrel sub 22 is attached to the receiving end of the inner barrel 18 and has an annular rim 24 disposed around the open end thereof.

A core catcher sub 26 is threadedly engaged with the inner barrel sub 22. A core catcher 28 is disposed in the core catcher sub 26 adjacent the opening thereof. The core catcher sub 26 has a receiving end 30 for receiving the core that is being formed. The annular channel 20 is disposed between the wall formed by the outer barrel 12, the core bit sub 14 and the coring bit 16 in the wall formed by the inner barrel 18, the inner barrel sub 22 and the core catcher sub 26.

The end of the inner barrel 18 opposite that attached to the inner barrel sub 22 has a flow tube 40 threadedly attached thereto. The flow tube 40 has an orifice 42 disposed axially therethrough. Although not shown, fluid also flows around the flow tube 40 into the annular channel 20 for passage to the surface of the coring bit 16. A check valve seat 44 is disposed in the orifice 42 of the flow tube 40. The seat 44 has an orifice 46 axially disposed therethrough to allow communication between the orifice 42 and the interior of the inner barrel 18. A check valve ball 48 is disposed in the seat 44 for impeding afferent flow to the inner barrel 18. However, the ball 48 is operable to allow afferent flow from the interior of the inner barrel 18 when the pressure interior thereto exceeds the pressure in the orifice 42 of the flow tube 40. The ball 48 and the seat 44 form an overall check valve 49.

A cylindrical sponge 50 is disposed on the interior walls of a cylindrical support member or liner 52. The liner 52 is dimensioned to slideably fit within the inner barrel 18 adjacent the walls thereof. In the preferred embodiment, the support member 52 is fabricated from aluminum and the sponge 50 is fabricated from polyurethane foam, as will be described hereinbelow. The use and construction of this foam is disclosed in U.S. Pat. No. 4,312,414, issued to the present Applicant.

The sponge 50 is dimensioned to define a bore through the middle thereof for receiving the core. The inner diameter of the sponge 50 is dimensioned to be slightly less than the diameter of the core being formed. This allows the sponge 50 to form a very tight fit with the core that is formed therein to provide for efficient transfer of fluid stored in the core to the sponge 50 for retention therein. This retention of fluid which is normally oil and/or gas enables a profile to be formed along the longitudinal axis of the core for later analysis. It is important that there is a free flow of mobile oil from the core to the sponge 50.

Figure 3:
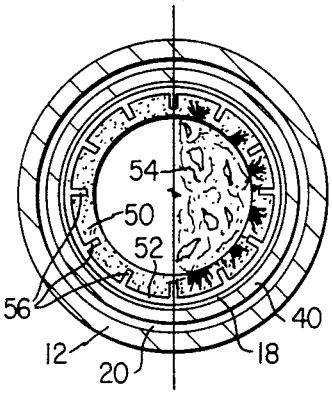
FIG. 3 illustrates a cross-sectional diagram of the core liner of FIG. 2 showing the core with and without a core in place.
Figure 2:
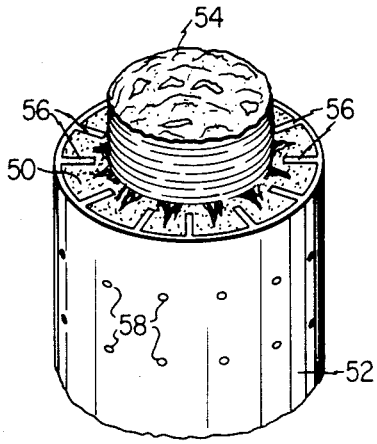
FIG. 2 illustrates a perspective view of the core liner, the core and the core in situ.

Referring now to FIGS. 2 and 3, there is illustrated a perspective view of a section of the sponge 50 and liner 52 with a section of a core 54 disposed therein. FIG. 3 illustrates a cross-sectional view illustrating the core 54 disposed in only a part of the bore formed within the sponge 50. The liner 52 has a plurality of longitudinal reinforcing members 56 disposed on the inner surface thereof and extending radially inwardly within the sponge 50. The reinforcing members 56 are dimensioned such that they are totally enclosed within the sponge 50 so as not contact the core 54. The reinforcing members 56 are operable to minimize tangential movement of the sponge 50 with respect to the inner surface of the liner 52 along the longitudinal axis thereof. Under certain conditions such as fractured cores where the core 54 does not easily slide up through the center portion of the sponge 50, the upward force resulting from these fractured cores can cause the sponge 50 to tear and separate from the inner wall of the linear 52. The inner surface of the liner 52 and the exterior surface of the sponge 50 do not necessarily form a firm bond. Therefore, when portions of the sponge 50 separate, they precede the core 54 up into the inner barrel, resulting in "jamming". This jamming prevents extraction of a full core from the subterranean well, thus providing questionable results.

The reinforcing members 56 may be separate members that are attached to the inner side of the liner 52 with screws or rivets or, in the preferred embodiment, the reinforcing members 56 can be extruded with the liner 52 in one operation. Also, the reinforcing members 56 are oriented along the longitudinal axis of the liner 52 such that structural integrety is imparted to the sponge 50 primarily along the path that core traverses.

A plurality of orifices 58 are interspersed about the surface of the liner 52 extending from the outer surface thereof to the inner surface thereof. The orifices 58 are operable to relieve pressure from the interior of the liner 52. To achieve a fairly accurate profile of the oil contained within the core 54, it is important, as described above, to laterally absorb the fluid contained within the core 54 into the sponge 50. In subterranean wells, the pressures encountered are relatively high as compared to atmospheric pressure. Since the sponge 50 is installed in the inner barrel 18 at approximately atmospheric pressure, a relatively high differential pressure exists at the bottom of the subterranean well between the fluids contained therein and the interstices of the sponge 50. If air is utilized in the interstices of the sponge 50, compression thereof may result, thereby causing a gap to form between the sponge 50 and the core 54. This gap allows drilling mud to circulate therebetween and "cake" thereon, thereby impeding transfer of mobile oil from the core 54 to the sponge 50. To alleviate the compression of the sponge 50, a fluid is disposed in the interstices thereof. The use and function of this fluid is discussed in a co-pending application Ser. No. 513,267, filed July 13, 1983 now U.S. Pat. No. 4,479,557.

When the apparatus 10 with the core in place is retracted from the well, the fluids disposed in both the sponge 50 and the core 54 are subjected to a decreasing pressure. This results in expansion of the fluids contained therein and, in addition, gases held in solution come out of solution as the pressure decreases. This expansion of the fluid is compensated for by the orifices 58 disposed in the liner 52 by allowing fluids or gases present in the sponge 50 to pass laterally outward therefrom. This lateral movement of the fluids and gases disposed in the sponge 50 prevents a back pressure from forming therein that can impede free transfer of mobile oil present in the core 54 into the sponge 50. In addition, gases coming out of solution are also allowed to escape through the orifices 58 and, since this formation of a gas results in a much greater volumetric expansion than the fluid, the orifices provide an important pressure relief function. The fluids and/or gases pass from the orifices 58 to the space between the liner 52 and the inside wall of the inner barrel 18, since the fit therebetween is a sliding fit only.

In summary, there has been provided a coring apparatus that has an inner barrel disposed within an outer barrel for receiving the core therein. A hollow cylinder of sponge is disposed within the inner barrel for disposition adjacent the walls of the bore. The sponge absorbs the fluid contained within the core and is disposed within a liner that is slideably inserted into the inner barrel. A plurality of reinforcing members are disposed on the liner and enclosed within the sponge to prevent movement of the sponge with respect to the liner. A plurality of orifices are disposed in the liner to allow gas and/or fluid to escape from the sponge to the exterior of the liner when fluid from the core bleeds into the sponge to prevent a building of backpressure therein.

Although the preferred embodiment has been described in detail, it should be understood that various changes, substitutions and alterations can be made therein without departing from the spirit and scope of the invention as defined by the appended claims.

What is claimed is:

1. An apparatus for absorbing subterranean fluid from a core disposed in the inner barrel of a well coring apparatus, comprising:

a right circular support member having a hollow interior open at both ends and dimensioned to fit adjacent the sides of the inner barrel;

an absorbent member disposed in said support member and attached to the sides thereof, said absorbent member having a bore formed through the center thereof and oriented along the longitudinal axis of the well coring apparatus for receiving a well core and absorbing the subterranean fluid that bleeds from the well core; and reinforcing means disposed interior to said absorbent member and attached to said support member for providing reinforcement along the longitudinal axis of the well coring apparatus such that structural integrity of said absorbent member is maintained under forces resulting from the core passing into the inner barrel of the well coring apparatus during the forming of the core, said reinforcing means dimensioned such that it does not extend through said absorbent member to contact the core as the core passes upward into said absorbent member.

2. The apparatus of claim 1 further comprising relief means for relieving pressure in said absorbent member resulting from bleeding of subterranean fluid from the core into said absorbent member such that lateral movement of fluids from the core to said absorbent member is unimpeded.

3. The apparatus of claim 2 wherein said relief means comprises a plurality of orifices disposed in said support member for allowing gas and fluid to exhaust from said absorbent member therethrough.

4. The apparatus of claim 3 wherein said plurality of orifices are arranged in an ordered array.

5. The apparatus of claim 1 wherein said support member comprises a right circular cylinder having an outer diameter essentially equal to the inner diameter of the inner barrel for slideably inserting therein.

6. The apparatus of claim 5 wherein said right circular cylinder is fabricated from aluminum.

7. The apparatus of claim 1 wherein said absorbent member comprises an open celled material having a high porosity.

8. The apparatus of claim 7 wherein said open celled material is comprised of polyurethane foam.

9. The apparatus of claim 1 wherein said reinforcing means comprises a plurality of longitudinal ridges disposed on the surface of said support member adjacent said absorbent member, said ridges oriented parallel to the longitudinal axis of the well coring apparatus.

10. The apparatus of claim 9 wherein said ridges are integral with said support member.

11. A well coring apparatus for extracting subterranean fluid from a sample of material in a subterranean well, comprising:

means for forming a core that contains the subterranean fluid, said coring means having:

an outer barrel for rotation in the well, an inner barrel disposed in said outer barrel and stationary with respect to rotation of said outer barrel, and a coring bit attached to said outer bit for forming a well core, said inner barrel for receiving said well core; and an absorbent member disposed in said inner barrel adjacent said well core to absorb the subterranean fluid that bleeds therefrom, said absorbent member having:

a support tube having a hollow interior and open at both ends thereof, an absorbent layer of material disposed on the interior of said support tube, the combination of said absorbent layer and support tube forming a bore therethrough for receiving said well core, and a plurality of ridges formed on the interior wall of said support tube and integral therewith, said ridges aligned along the longitudinal axis of said support tube and embedded in said absorbent layer for maintaining the structural integrity of said absorbent layer during the formation of said well core such that the possibility of tearing of said absorbent layer is minimized when the core enters said absorbent member and moves upward therein.

12. The apparatus of claim 11 wherein said absorbent member further comprises relief means for relieving pressure within said absorbent layer resulting from subterranean fluid transferring from the core to said absorbent member.

13. The apparatus of claim 12 wherein said relief means comprises a plurality of orifices disposed in the wall of said support tube.

14. The apparatus of claim 11 wherein said absorbent layer is fabricated from polyurethane foam, said foam fabricated about said ridges.

15. A well coring apparatus for forming a well core and extracting subterranean fluid from the well core, comprising:

means for forming the well core, said coring means having:

an outer barrel, an inner barrel disposed within said outer barrel for receiving the well core, a coring bit attached to said outer barrel and corotatable therewith, and means for rotating said outer barrel, said inner barrel and said coring bit; and an absorbent member disposed in said inner barrel for extracting the subterranean fluid contained in the core, said absorbent member having:

a support tube having an outer diameter that is essentially equal to the inner diameter of said inner barrel such that said support tube is slideable therein, a pluality of reinforcing ridges disposed on the interior wall of said support tube and parallel with the longitudinal axis thereof and integral therewith, the distance between the portion of said ridges nearestmost the central axis of said support tube being greater than the diameter of the well core such that said ridges do not contact the well core, and an absorbent layer of polyurethane foam disposed on the interior wall of said support tube to form a bore along the longitudinal axis of said support tube for receiving the core, the interior diameter of said bore dimensioned to be slightly less than the diameter of said core wherein said reinforcing ridges retain the structural integrity of said absorbent layer during formation of the core to prevent movement of said absorbent layer relative to said ridges, said ridges totally encompassed by said absorbent layer.

* * * * *